US011053740B2

(12) United States Patent
Chen

(10) Patent No.: US 11,053,740 B2
(45) Date of Patent: Jul. 6, 2021

(54) DOWNHOLE TOOL SURFACES CONFIGURED TO REDUCE DRAG FORCES AND EROSION DURING EXPOSURE TO FLUID FLOW

(71) Applicant: Halliburton Energy Services, Inc., Houston, TX (US)

(72) Inventor: Hau-Jiun Chen, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 450 days.

(21) Appl. No.: 15/531,078

(22) PCT Filed: Dec. 30, 2014

(86) PCT No.: PCT/US2014/072754
§ 371 (c)(1),
(2) Date: May 26, 2017

(87) PCT Pub. No.: WO2016/108842
PCT Pub. Date: Jul. 7, 2016

(65) Prior Publication Data

US 2017/0342778 A1 Nov. 30, 2017

(51) Int. Cl.
*E21B 10/43* (2006.01)
*E21B 4/02* (2006.01)
(Continued)

(52) U.S. Cl.
CPC ..... *E21B 10/43* (2013.01); *E21B 4/02* (2013.01); *E21B 17/1078* (2013.01); *F03B 13/02* (2013.01)

(58) Field of Classification Search
CPC ..... E21B 10/43; E21B 4/02; E21B 17/1078; F03B 13/02
See application file for complete search history.

(56) References Cited

U.S. PATENT DOCUMENTS 4,467,879 A 8/1984 Burge
5,494,123 A 2/1996 Nguyen
(Continued)

FOREIGN PATENT DOCUMENTS

AU 755488 12/2002
EP 2539622 1/2013
(Continued)

OTHER PUBLICATIONS

Office Action for Canadian Patent Application No. 2969232, dated Apr. 24, 2018; 3 pages.
(Continued)

*Primary Examiner* — Yong-Suk (Philip) Ro
(74) *Attorney, Agent, or Firm* — Benjamin Ford; Baker Botts L.L.P.

(57) ABSTRACT

A first method of configuring a surface of a component exposed to fluid flow includes forming a plurality of protrusions on a surface, the plurality of protrusions separated by a plurality of channels, and depositing a coating on the surface to increase a coefficient of friction of the surface, the coating formed of a diamond-like carbon and having a wrinkled texture. A second method of configuring a surface of a component exposed to fluid flow includes forming a plurality of protrusions on a surface, the plurality of protrusions separated by a plurality of channels, and forming a plurality of nanotubes on the surface.

12 Claims, 7 Drawing Sheets

(51) Int. Cl.
*F03B 13/02* (2006.01)
*E21B 17/10* (2006.01)

(56) References Cited

U.S. PATENT DOCUMENTS

| | | | | |
|---|---|---|---|---|
| 5,853,054 | A | 12/1998 | McGarian et al. | |
| 6,260,636 | B1 | 7/2001 | Cooley et al. | |
| 6,345,791 | B1 | 2/2002 | McClure | |
| 7,770,664 | B2 | 8/2010 | Laird et al. | |
| 7,823,665 | B2 | 11/2010 | Sullivan et al. | |
| 7,968,184 | B2 | 6/2011 | Humphreys et al. | |
| 8,551,376 | B2 | 10/2013 | Lemaire et al. | |
| 8,561,726 | B2 | 10/2013 | Salzer, III et al. | |
| 8,631,864 | B2 | 1/2014 | Saenger et al. | |
| 2001/0017224 | A1 | 8/2001 | Evans et al. | |
| 2005/0031794 | A1 | 2/2005 | Darolia et al. | |
| 2008/0083568 | A1 | 4/2008 | Overstreet et al. | |
| 2009/0025982 | A1 | 1/2009 | Hall et al. | |
| 2010/0044110 | A1* | 2/2010 | Bangru | C23C 14/0605 175/61 |
| 2010/0108393 | A1 | 5/2010 | John et al. | |
| 2011/0174548 | A1 | 7/2011 | Patel et al. | |
| 2011/0287223 | A1 | 11/2011 | Victor et al. | |
| 2012/0205162 | A1 | 8/2012 | Patel et al. | |
| 2012/0292043 | A1* | 11/2012 | Thornton | E21B 17/1042 166/369 |
| 2012/0292117 | A1 | 11/2012 | John et al. | |
| 2013/0025941 | A1* | 1/2013 | Kumar | C23C 30/005 175/57 |
| 2013/0032411 | A1* | 2/2013 | John | C09D 127/18 175/320 |
| 2013/0333213 | A1 | 12/2013 | Lebret et al. | |

FOREIGN PATENT DOCUMENTS

| | | |
|---|---|---|
| GB | 947440 | 1/1964 |
| GB | 2164372 | 3/1986 |
| GB | 2166177 | 4/1986 |
| SU | 901457 | 1/1982 |
| WO | 2011/102820 | 8/2011 |
| WO | 2012/116036 | 8/2012 |
| WO | 2013/016641 | 1/2013 |
| WO | 2014/022025 | 2/2014 |

OTHER PUBLICATIONS

International Preliminary Report on Patentability for PCT Patent Application No. PCT/US2014/072754, dated Jul. 13, 2017; 11 pages.

R.Pflumm, et al., "A Shark Skin for High Temperature Applications." High Temperature Materials (DFG) 2014; 1 page.

Tian, Limei, et al. "Effects and mechanisms of surface topography on the antiwear properties of molluscan shells (*Scapharca subcrenata*) using the fluid-solid interaction method." The Scientific World Journal 2014 (2014); 13 pages.

Kim, Seong Jin, et al. "Frictional behavior on wrinkle patterns of diamond-like carbon films on soft polymer." Diamond and Related Materials 23 (2012): 61-65; 5 pages.

Ion Implantation, Retrieved from http://www.bodycote.com/services/heat-treatment/ion-implantation.aspx; 1 page.

International Search Report and Written Opinion for PCT Patent Application No. PCT/US2014/072754, dated Sep. 14, 2015; 17 pages.

Hage, Wolfram, Volkmar Stenzel, and Taras Vynnyk. "Investigation of the Wear Properties of a Riblet Paint Structure on an Airbus A300-600ST Beluga." New Results in Numerical and Experimental Fluid Mechanics VIII. Springer Berlin Heidelberg, 2013. 185-192; 8 pages.

Dean, Brian, and Bharat Bhushan. "Shark-skin surfaces for fluid-drag reduction in turbulent flow: a review." Philosophical Transactions of the Royal Society of London A: Mathematical, Physical and Engineering Sciences 368.1929 (2010): 4775-4806; 33 pages.

* cited by examiner

DOWNHOLE TOOL SURFACES CONFIGURED TO REDUCE DRAG FORCES AND EROSION DURING EXPOSURE TO FLUID FLOW

RELATED APPLICATIONS

This application is a U.S. National Stage Application of International Application No. PCT/US2014/072754 filed Dec. 30, 2014, which designates the United States, and which is incorporated herein by reference in its entirety.

TECHNICAL FIELD

The present disclosure is related to surfaces configured to reduce drag forces and erosion during exposure to fluid flow.

BACKGROUND OF THE DISCLOSURE

During the operation of fluid flow systems, fluids circulating within the system may flow over the surfaces of components of the system. The circulation of fluids over the surfaces of components may cause these surfaces to erode, which may cause the components to fail prematurely or may reduce the lifespan of such components. Additionally, the circulation of fluids over the surfaces of components may increase drag forces exerted on the component, which may reduce the efficiency of the system.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

Embodiments of the present disclosure and its advantages may be understood by referring to FIGS. 1 through 8, where like numbers are used to indicate like and corresponding parts.

The flow of fluids over the surfaces of a component may cause the surfaces to erode and may increase the drag forces exerted on the component, particularly where the component rotates during operation. The surfaces exposed to fluid flow may be configured to reduce the drag forces and erosion caused by fluids flowing over the surface. For example, surfaces exposed to drilling fluids, other preparation fluids, or production fluids may be configured to reduce drag forces and erosion caused by including one or more of: (a) a series of protrusions separated by channels formed on the surface, (b) an array of nanotubes formed on the surface, or (c) a diamond-like coating deposited on the surface.

Figure 1:
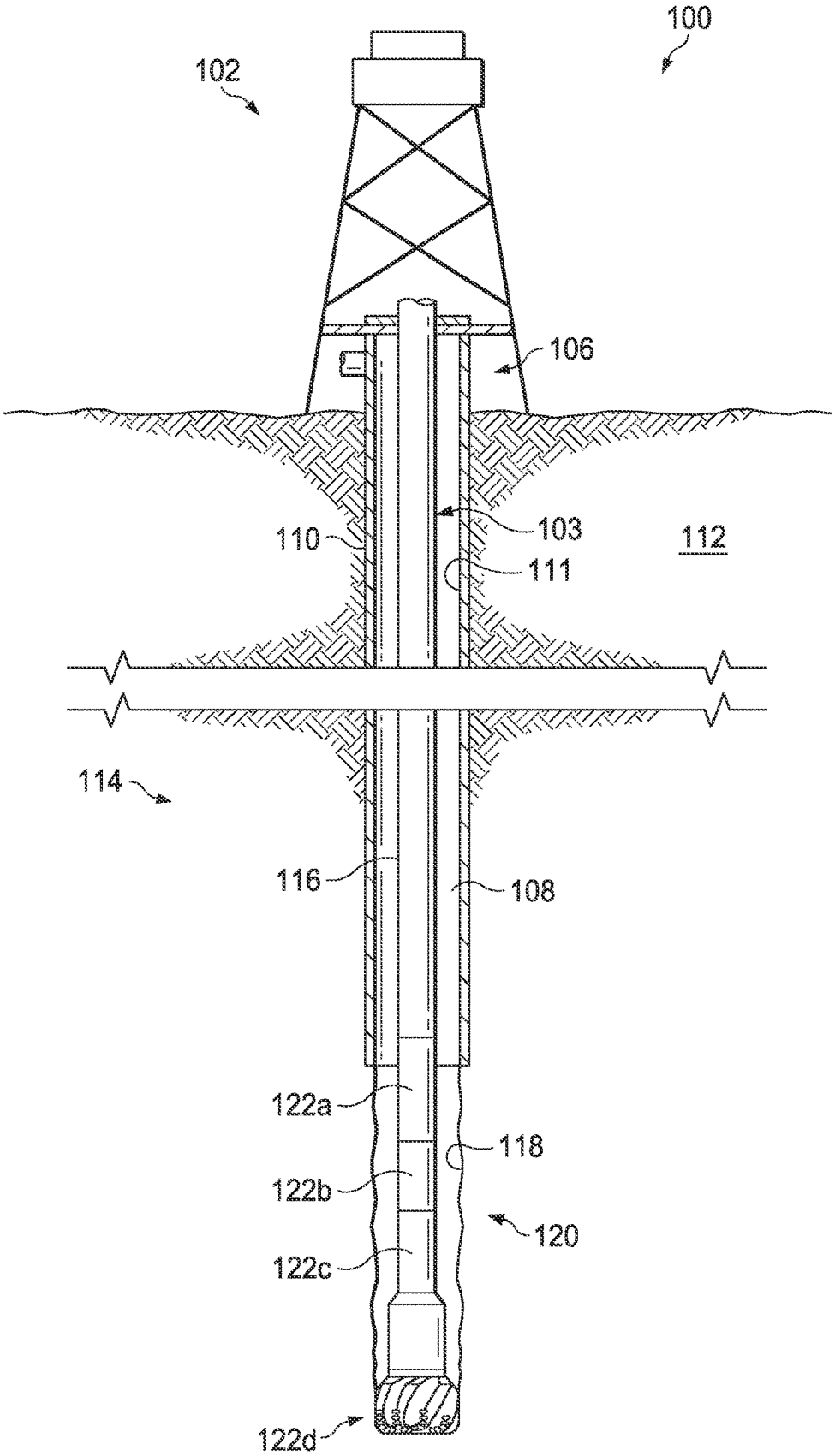
FIG. 1 is an elevation view of a drilling system.

FIG. 1 is an elevation view of an example embodiment of a drilling system. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102, which may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 122*d*, which may be used to form a wide variety of wellbores or bore holes such as wellbore 114. The term "wellbore" may be used to describe any hole drilled into a formation for the purpose of exploration or extraction of natural resources such as, for example, hydrocarbons, or for the purpose of injection of fluids such as, for example, water, wastewater, brine, or water mixed with other fluids. Additionally, the term "wellbore" may be used to describe any hold drilled into a formation for the purpose of geothermal power generation. As shown in FIG. 1, wellbore 114 may be drilled through earth formation 112. Casing string 110 may be placed in wellbore 114 and held in place by cement, which may be injected between casing string 110 and the sidewalls of wellbore 114. Casing string 110 may provide radial support to wellbore 114 and may seal against unwanted communication of fluids between wellbore 114 and surrounding formation 112. Casing string 110 may extend from well surface 106 to a selected downhole location within wellbore 114. Portions of wellbore 114 that do not include casing string 110 may be described as "open hole." In addition, liner sections (not expressly shown) may be present and may connect with an adjacent casing or liner section. Liner sections (not expressly shown) may not extend to the well site 106. Liner sections may be positioned proximate the bottom, or downhole, from the previous liner or casing. Liner sections may extend to the end of wellbore 114.

The terms "uphole" and "downhole" may be used to describe the location of various components relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Drilling system 100 may also include bottom hole assembly (BHA) 120 coupled to the downhole end of drill string 103. Various directional drilling techniques and associated components of bottom hole assembly (BHA) 120 may be used to form wellbore 114. BHA 120 may be formed from a wide variety of components configured to form a wellbore. For example, components 122*a*, 122*b*, 122*c*, and 122*d* of BHA 120 may include, but are not limited to, drill bits (e.g., drill bit 122*d*), coring bits, drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number and types of components 122 included in BHA 120 may depend on anticipated downhole drilling conditions and the type of wellbore that will be formed by drill string 103 and BHA 120.

Various types of drilling fluid may be pumped from well surface 106 through drill string 103 to BHA 120. Such drilling fluids may be directed to flow from drill string 103 to nozzles (not expressly shown) included in drill bit 122*d*. The drilling fluid may be circulated back to well surface 106 through an annulus 108 defined in part by outside diameter 116 of drill string 103 and inside diameter 118 of wellbore 114. Inside diameter 118 may be referred to as the "sidewall" or "bore wall" of wellbore 114. Annulus 108 may also be defined by outside diameter 116 of drill string 103 and inside diameter 111 of casing string 110.

The flow of drilling fluids in annulus 108 may cause the surfaces of drill string 103, BHA 120, and other tools, pipes, or tubing located in wellbore 114 to erode. Additionally, the flow of drilling fluids in annulus 108 may increase the drag forces exerted on drill string 103, and components 122 of BHA 120 as they rotate within wellbore 114. The surfaces of drill string 103, components 122 of BHA 120, and other downhole tools, pipes, or tubing, may be configured to reduce the drag forces and erosion caused by the flow of drilling fluids by including one or more of: (a) a series of protrusions separated by channels formed on the surface, (b) an array of nanotubes formed on the surface, or (c) a diamond-like coating deposited on the surface.

Figure 2:
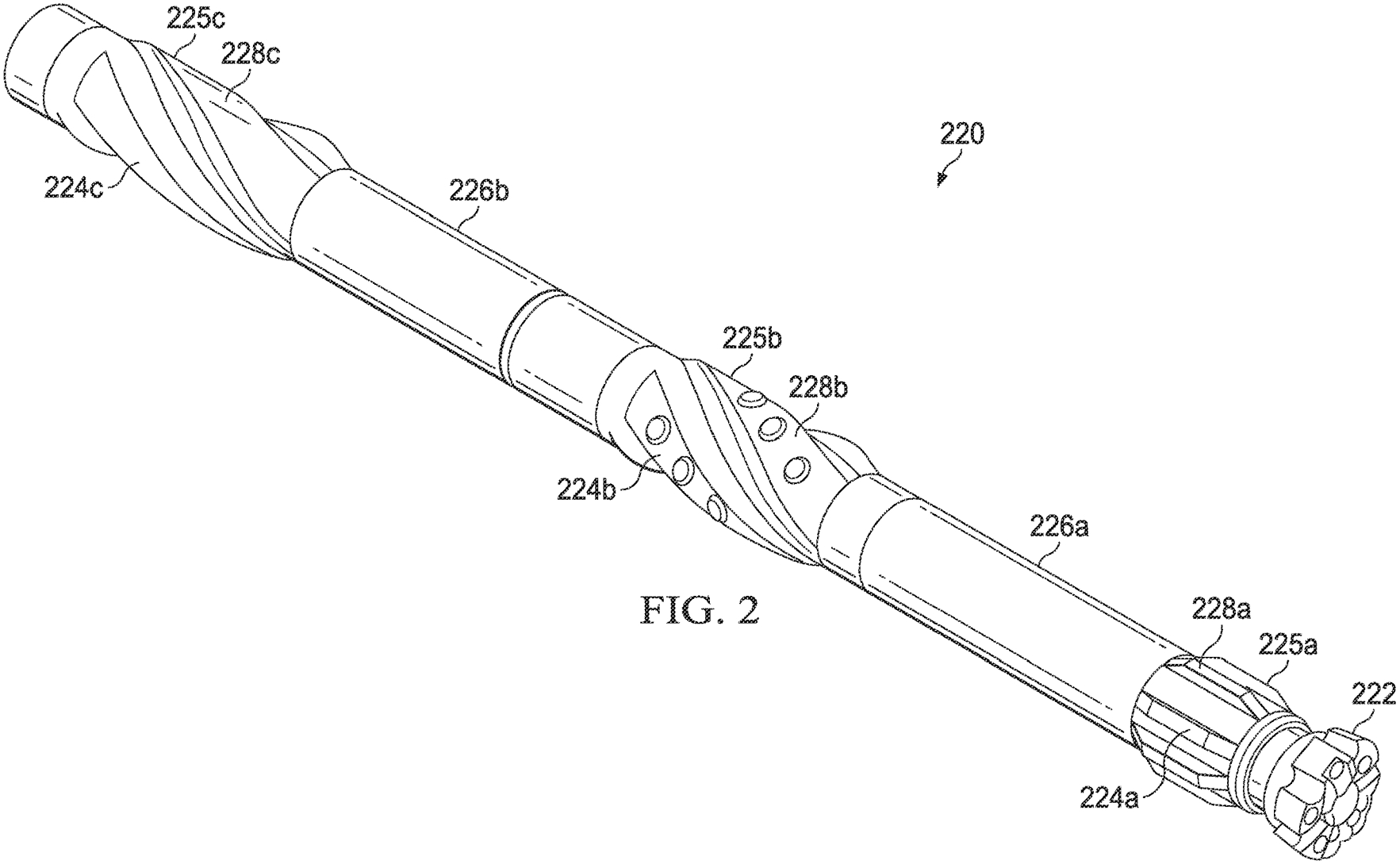
FIG. 2 is a side view of a bottom hole assembly including surfaces configured to reduce drag forces and erosion caused by drilling fluids.

FIG. 2 is a side view of a bottom hole assembly including surfaces configured to reduce drag forces and erosion caused by drilling fluids. Bottom hole assembly (BHA) 220 may include drill bit 222 disposed at the downhole end of BHA 220, stabilizers 224*a*, 224*b*, and 224*c* disposed uphole from drill bit 222, and collars 226*a* and 226*b* inserted between stabilizers 224. Stabilizers 224 may include a wide variety of stabilizers configured to stabilize drill bit 222, BHA 220, and/or drill string 103 (shown in FIG. 1). For example, stabilizers 224 may include near bit stabilizer 224*a*, adjustable gauge stabilizer 224*b*, and string stabilizer 224*c*. BHA 220 may include any number and types of stabilizers 224 based on the anticipated downhole drilling conditions and the type of wellbore that will be formed by drill string 103 and BHA 220. Collars 226 may include a first collar 226*a* disposed between near bit stabilizer 224*a* and adjustable gauge stabilizer 224*b*, and a second collar 226*b* disposed between adjustable gauge stabilizer 224*b* and string stabilizer 224*c*.

The flow of drilling fluids over surfaces 228 of stabilizers 224 may cause surfaces 228 to erode. Additionally, the flow of drilling fluid over surfaces 228 may exert a drag force on stabilizers 224 as they rotate within wellbore 114 (shown in FIG. 1). Surface 228 may be configured to reduce the drag forces and erosion caused by the flow of drilling fluids by including one or more of: (a) a series of protrusions, including nodules (shown in FIGS. 3A-3B) or ribs (shown in FIGS. 4A-4B), separated by channels formed on surface 228, (b) an array of nanotubes (shown in FIGS. 5A-5B) formed on surface 228, or (c) a diamond-like coating (shown in FIGS. 6A-6C) deposited on surface 228.

Figure 3A:
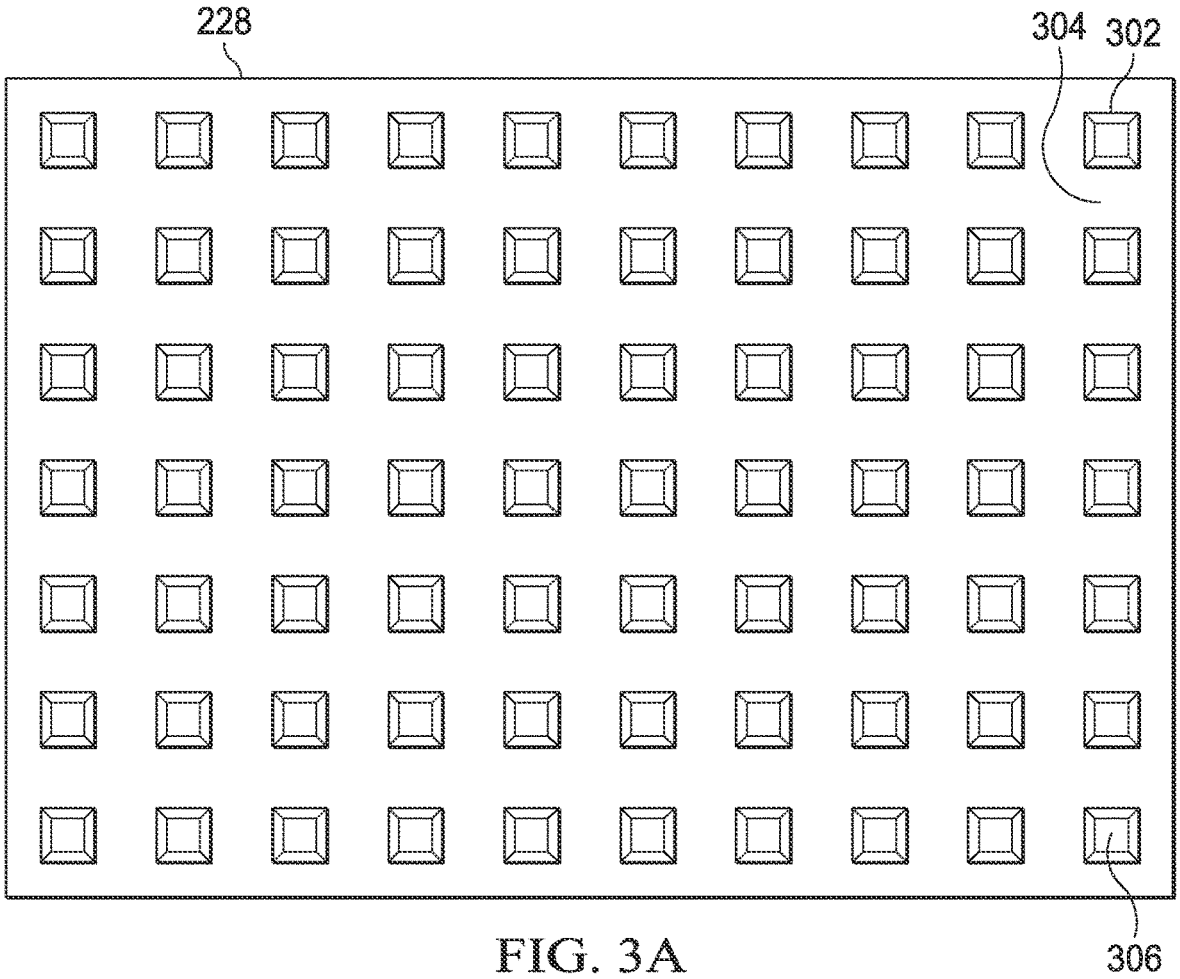
FIG. 3A is a top-view of a section of a surface including nodules formed thereon to reduce drag forces and erosion caused by drilling fluids.
Figure 3B:
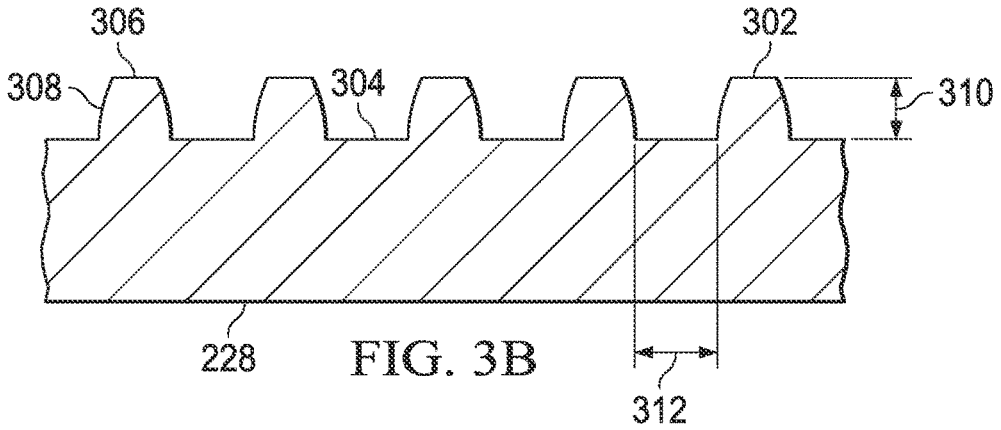
FIG. 3B is a cross-sectional view of a section of the surface illustrated in FIG. 3A including nodules formed thereon to reduce drag forces and erosion caused by drilling fluids.

FIGS. 3A and 3B illustrate a section of a surface including nodules formed thereon to reduce drag forces and erosion caused by drilling fluids. Specifically, FIG. 3A is a top-view of a section of a surface including nodules formed thereon to reduce drag forces and erosion caused by drilling fluids and FIG. 3B is a cross-sectional view of a section of the surface illustrated in FIG. 3A including nodules formed thereon to reduce drag forces and erosion caused by drilling fluids. As shown in FIG. 3A, surface 228 may include a series of nodules 302 separated by channels 304. The addition of nodules 302 and channels 304 to surface 228 may decrease the impact velocity of drilling fluids flowing over surface 228 and thus reduce drag forces and erosion caused by drilling fluids.

Nodules 302 may be formed using a variety of methods. As an example, material may be removed from surface 228 to form channels 304. The material not removed from surface 228 in this process may form nodules 302. Material may be removed from surface 228 to form channels 304 using any suitable method, including, but not limited to a machine tool or a chemical etching process. As another example, material may be deposited on surface 228 to form nodules 302. Material may be deposited on surface 228 using a physical or chemical deposition process. As yet another example, surface 228 may be stamped or molded to form nodules 302 and channels 304. As still another example, nodules 302 may be formed using an ion implantation process.

The shape of nodules 302 may vary depending upon the anticipated fluid flow conditions (e.g., pressure, turbulence, viscosity) to which surface 228 may be exposed. For example, although nodules 302 are shown in FIG. 3A as being substantially square-shaped, nodules 302 may be any shape, including, but not limited to a rectangle, circle, semi-circle, oval, triangle, or polygon. Additionally, although faces 306 and 308 of nodules 302 are shown in FIG. 3B as being substantially perpendicular to one other, the angles of faces 306 and 308 may vary depending upon the anticipated fluid flow conditions to which nodules 302 may be exposed. For example, the angles of faces 306 and 308 may vary depending upon the anticipated fluid flow conditions (e.g., pressure, turbulence, viscosity) to which surface 228 may be exposed. Further, although face 306 of nodules 302 is shown in FIG. 3B as being substantially planar, the surface profile of face 306 may vary depending upon the anticipated fluid flow conditions (e.g., pressure, turbulence, viscosity) to which surface 228 may be exposed.

Similarly, the size of nodules 302 and channels 304 may vary depending upon the anticipated fluid flow conditions (e.g., pressure, turbulence, viscosity) to which surface 228 may be exposed. The surface area of surface 306 and/or height 310 of nodules 302 may be increased or decreased based on the anticipated fluid flow conditions (e.g., pressure, turbulence, viscosity) to which the surface 228 may be exposed. As an example, the surface area of surface 306 of nodules 302 may be between approximately 1 mm and 3 mm, while height 310 of nodules 302 may be between approximately 0.5 mm and 1 mm and width 312 of channels may be between approximately 0.5 mm and 1.5 mm. Although each of nodules 302 is shown in FIGS. 3A and 3B as being substantially similar in shape and size, nodules 302 may vary in shape and size across surface 228.

Figure 4A:
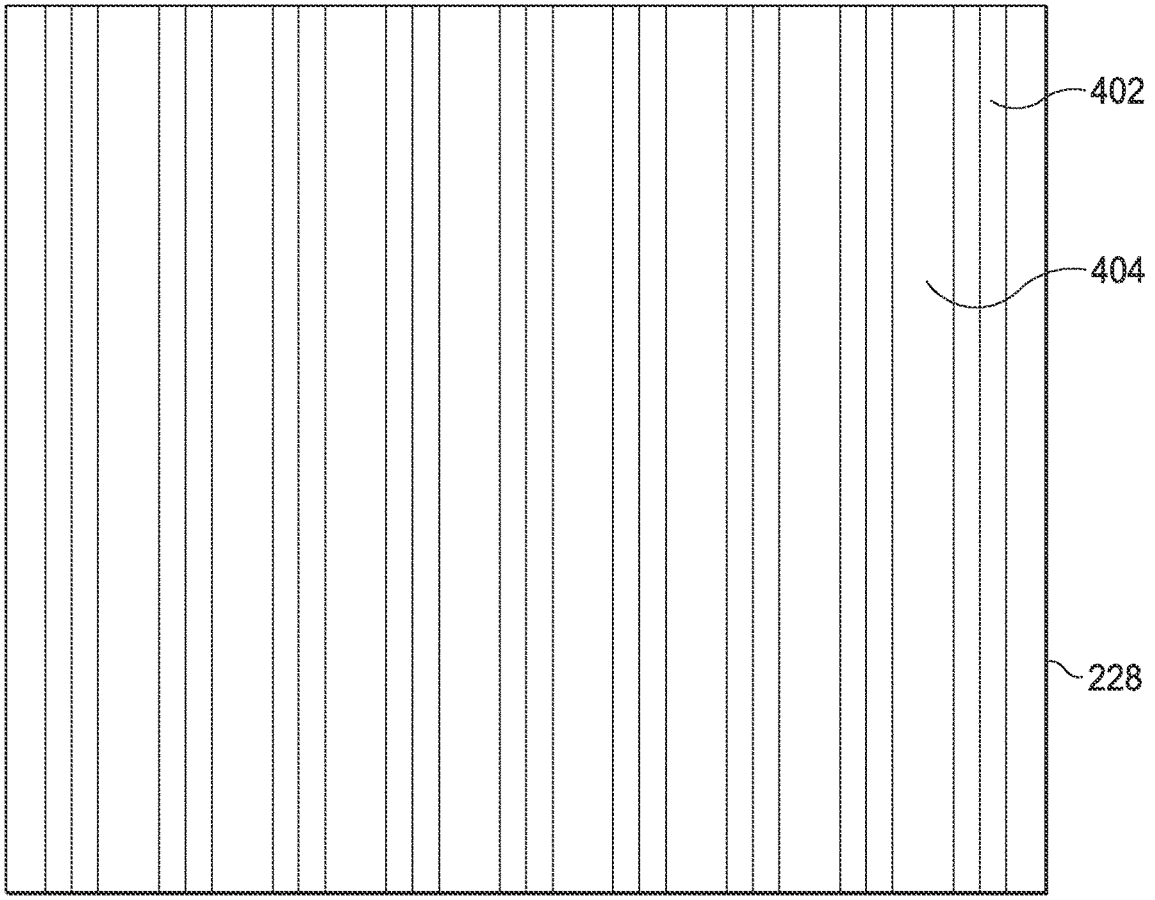
FIG. 4A is a top-view of a section of a surface including ribs formed thereon to reduce drag forces and erosion caused by drilling fluids.
Figure 4B:
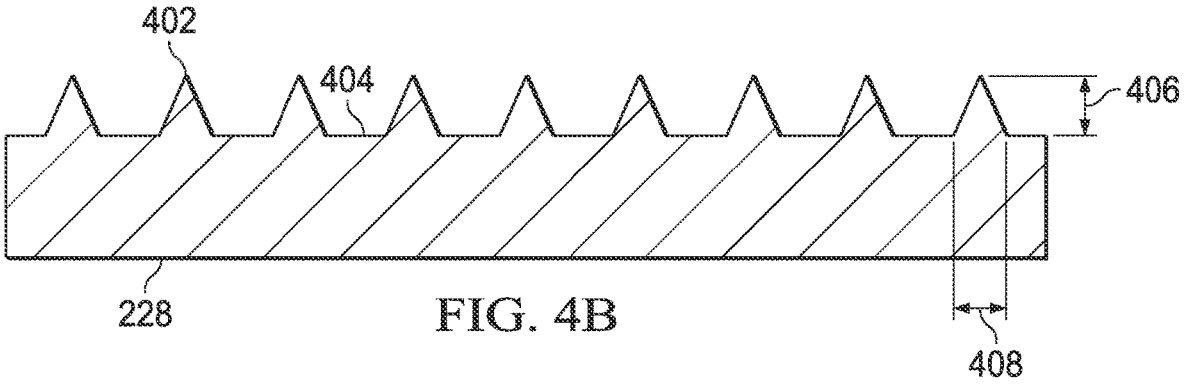
FIG. 4B is a cross-sectional view of a section of the surface illustrated in FIG. 4A including ribs formed thereon to reduce drag forces and erosion caused by drilling fluids.

FIGS. 4A and 4B illustrate a section of a surface including ribs formed thereon to reduce drag forces and erosion caused by drilling fluids. Specifically, FIG. 4A is a top-view of a section of a surface including ribs formed thereon to reduce drag forces and erosion caused by drilling fluids and FIG. 4B is a cross-sectional view of a section of the surface illustrated in FIG. 4A including ribs formed thereon to reduce drag forces and erosion caused by drilling fluids. As shown in FIG. 4A, surface 228 may include a series of ribs 402 aligned in the direction of fluid flow over surface 228 separated by channels 404. The addition of ribs 402 and channels 404 aligned in the direction of fluid flow to surface 228 may reduce turbulence in drilling fluids flowing over surface 228 and thus reduce drag forces and erosion caused by drilling fluids.

Ribs 402 may be formed using a variety of methods. As an example, material may be removed from surface 228 to form channels 404. The material not removed from surface 228 in this process may form ribs 402. Material may be removed from surface 228 to form channels 404 using any suitable method, including, but not limited to a machine tool or a chemical etching process. As another example, material may be deposited on surface 228 to form ribs 402. Material may be deposited on surface 228 using a physical or chemical deposition process. As yet another example, surface 228 may be stamped or molded to form ribs 402 and channels 404. As still another example, ribs 402 may be formed using an ion implantation process.

The shape and size of ribs 402 may vary depending upon the anticipated fluid flow conditions (e.g., pressure, turbulence, viscosity) to which surface 228 may be exposed. For example, although ribs 402 are shown in FIG. 4A as being substantially straight, ribs 402 may be also be curved in order to align with the direction of fluid flow over surface 228. Additionally, although ribs 402 are shown in FIG. 4B as having a triangular profile, ribs 402 may have a profile that is rectangular, square, semi-circular, or polygonal.

Height 406 and width 408 of ribs 402 may be increased or decreased based on the anticipated fluid flow conditions (e.g., pressure, turbulence, viscosity) to which the surface 228 may be exposed. As an example, height 406 of ribs 402 may be between approximately 1 mm and 3 mm, while width 408 of ribs 402 may be between approximately 0.5 mm and 1.5 mm. Although each of ribs 402 is shown in FIGS. 4A and 4B as being substantially similar in shape and size, ribs 402 may vary in shape and size across surface 228.

Figure 5A:
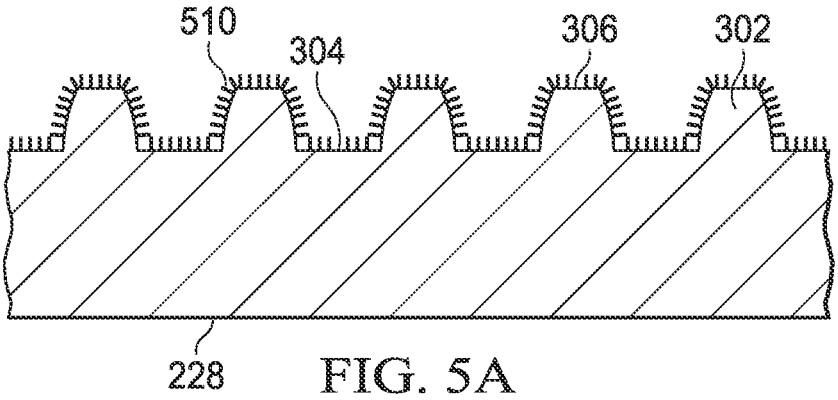
FIG. 5A is a cross-sectional view of a section of a surface including nanotubes formed thereon to reduce drag forces and erosion caused by drilling fluids.
Figure 5B:
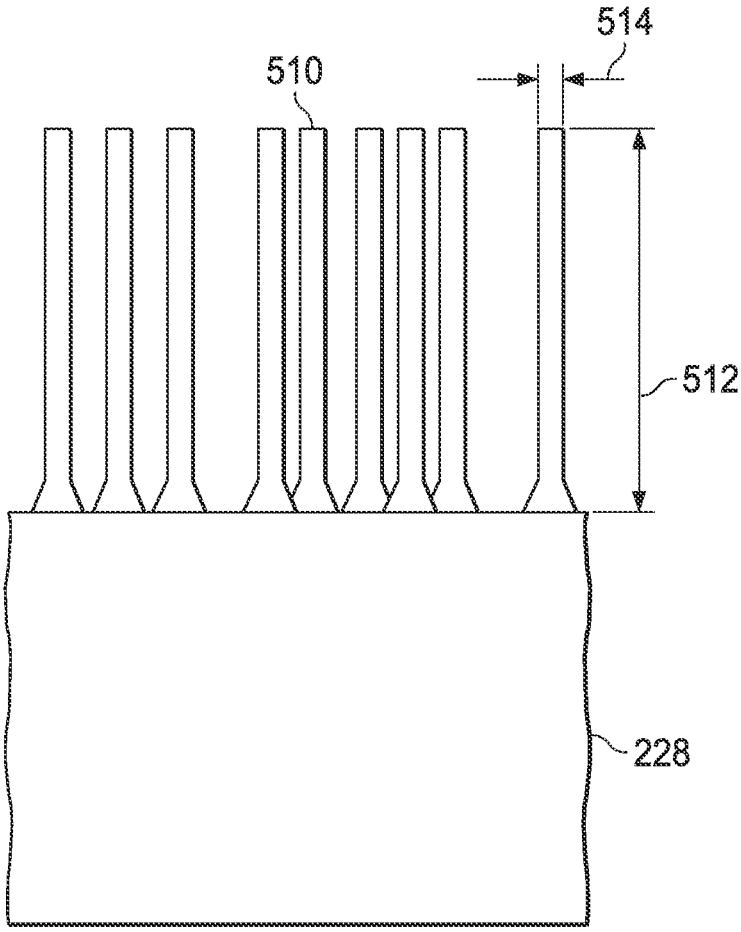
FIG. 5B is a cross-sectional view of a section of the surface illustrated in FIG. 5A including nanotubes formed thereon to reduce drag forces and erosion caused by drilling fluids.

FIGS. 5A and 5B illustrate a section of a surface including nanotubes formed thereon to reduce drag forces and erosion caused by drilling fluids. Specifically, FIG. 5A is a cross-sectional view of a section of a surface including nanotubes formed thereon to reduce drag forces and erosion caused by drilling fluids and FIG. 5B is a cross-sectional view of a section of the surface illustrated in FIG. 5A including nanotubes formed thereon to reduce drag forces and erosion caused by drilling fluids. As shown in FIGS. 5A and 5B, surface 228 may include an array of nanotubes 510 formed thereon. Although FIG. 5A illustrates nanotubes 510 formed on a surface including nodules (shown in FIGS. 3A and 3B), nanotubes may also be formed on a surface including ribs (as shown in FIGS. 4A and 4B), or on a surface that includes neither nodules nor ribs.

The addition of nanotubes 510 to surface 228 may reduce drag forces caused by drilling fluids flowing over surface 228 by preventing drilling fluids and particles circulating in drilling fluids from sticking or adhering the surface 228. For example, particles circulating in drilling fluids flowing over surface 228 may impact nanotubes 510 and be deflected away from surface 228 instead of sticking or adhering to surface 228. Additionally, the addition of nanotubes 510 to surface 228 may reduce erosion caused when erosive particles impact surface 228. For example, erosive particles circulating in drilling fluids flowing over surface 228 may impact nanotubes 510 before impacting surface 228. When an erosive particle impacts nanotubes 510, it may cause nanotubes 510 to deflect. As nanotubes 510 deflect, they may absorb some of the kinetic energy of the erosive particle and thus reduce the velocity of the erosive particle. By reducing the velocity of erosive particles before they impact surface 228, erosion of surface 228 may be reduced.

Nanotubes 510 may densely populate surface 228 such that erosive particles in drilling fluids flowing over surface 228 will impact one or more of nanotubes 510 before impacting surface 228. Nanotubes 510 may be formed directly on surface 228 or formed on a flexible substrate that is later adhered to surface 228. Nanotubes 510 may include single-walled carbon nanotubes (e.g., nanotubes formed of a single one-atom thick sheet of carbon rolled into a tube) or multi-walled carbon nanotubes (e.g., nanotubes formed from multiple sheets of carbon rolled into a tube). Average length 512 of nanotubes 510 may be approximately 1 μm or between 10 nm and 1 μm, between 50 nm and 1 μm, or between 50 nm and 1.5 μm. Average diameter 514 of nanotubes 510 may be between approximately 50 nm and 100 nm. Although nanotube formation processes tend to result in some uniformity in nanotube size and structure, nanotubes 510 may vary in diameter and length. Furthermore, nanotubes 510 may include a combination of single-walled carbon nanotubes and multi-walled carbon nanotubes. Carbon nanotubes may be in chiral, armchair, zigzag, or other configurations or in combinations of these configurations. Other nanostructures, such as graphene nanoribbons or nanosheets or nanobuds and nanospheres may be present in nanotubes 510. In addition, although nanotubes are conventionally formed form carbon, nanotubes 510 may include nanotubes formed from other materials, even if later developed.

Figure 6A:
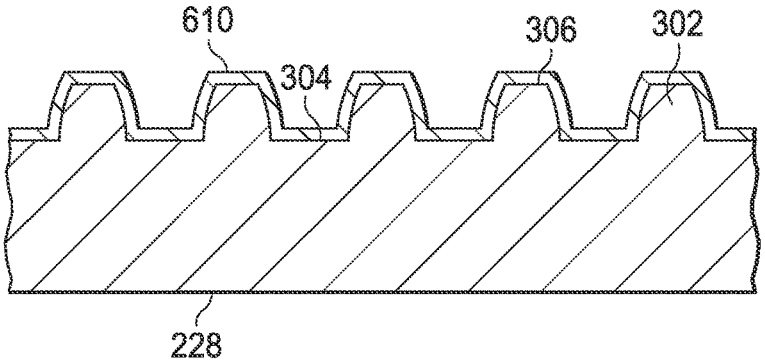
FIG. 6A is a cross-sectional view of a section of a surface on which a diamond-like coating has been deposited over nodules formed on the surface.
Figure 6B:
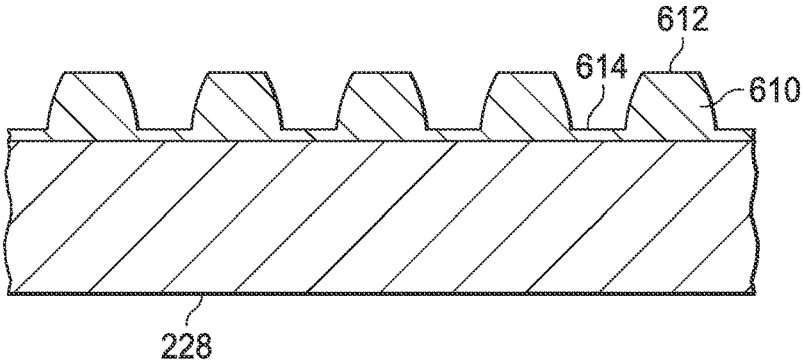
FIG. 6B is a cross-sectional view of a section of the surface illustrated in FIG. 6A on which a diamond-like coating has been deposited and etched to form nodules.
Figure 6C:
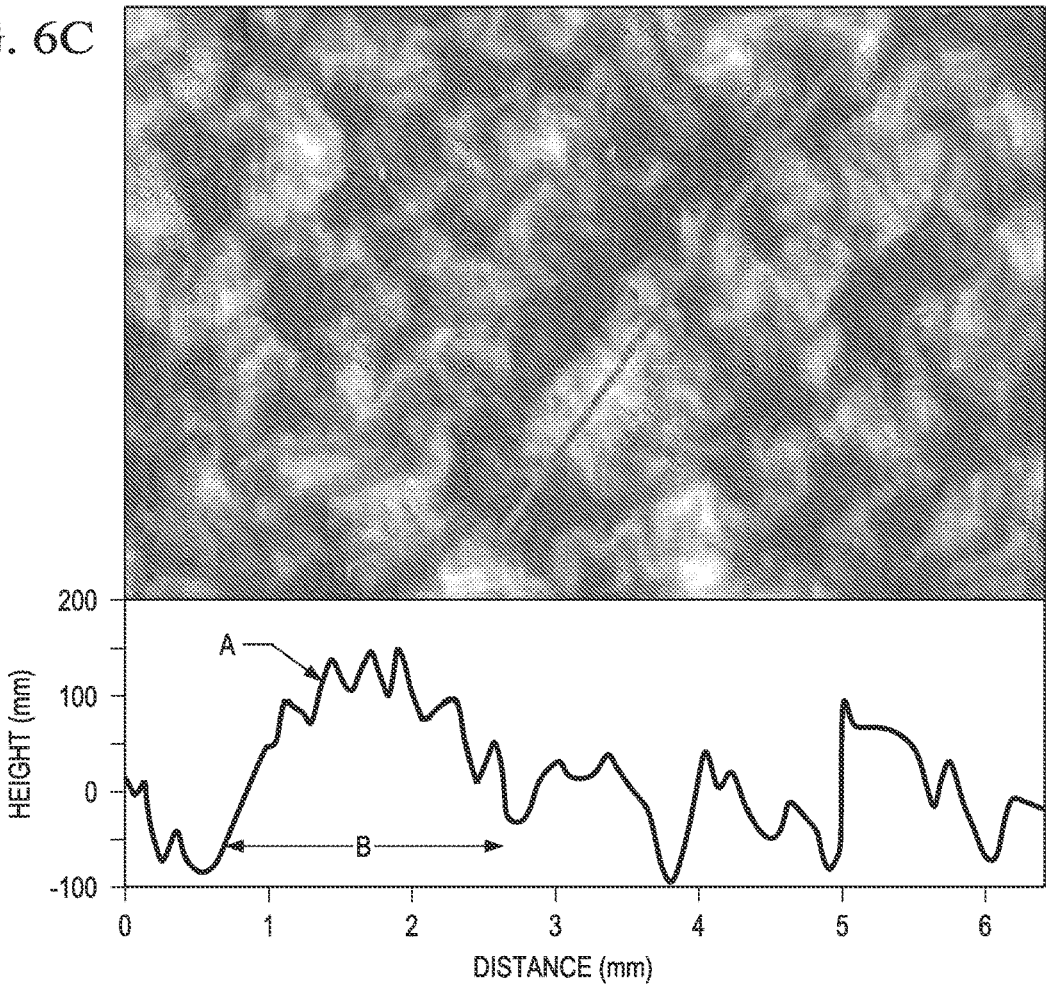
FIG. 6C illustrates the surface profile of a diamond-like coating deposited on the surface illustrated in FIGS. 6A and 6B.

FIGS. 6A-6C illustrate a section of a surface including a diamond-like coating. FIG. 6A is a cross-sectional view of a section of a surface on which a diamond-like coating has been deposited over nodules formed on the surface. Surface 228 may include nodules 302 formed thereon and coating 610 deposited on surface 228. Although FIG. 6A illustrates coating 610 deposited on a surface including nodules 302 formed thereon, coating 610 may also be deposited on a surface including ribs (as shown in FIGS. 4A-4B).

Alternatively, coating 610 may be deposited on surface 228 and then etched to form a series of nodules or ribs. FIG. 6B is a cross-sectional view of a section of the surface illustrated in FIG. 6A on which a diamond-like coating has been deposited and etched to form nodules. Following deposition, coating 610 may be etched to form a series of nodules 612 separated by channels 614. Although FIG. 6B illustrates coating 610 being etched to form a series of nodules separated by channels, coating 610 may also be etched to form a series of ribs separated by channels (as shown in FIGS. 4A-4B).

FIG. 6C illustrates the surface profile of the diamond-like coating deposited on the surface illustrated in FIGS. 6A-6B. Coating 610 may be deposited on surface 228 using a physical or chemical deposition process. Coating 610 may be formed of a composition including a diamond-like carbon. As shown in FIG. 6C, coating 610 may have a roughened surface profile. The surface profile of coating 610 may include variations in the thickness of coating 610 such that a jagged or wrinkled texture is formed. This wrinkled texture may be achieved by increasing the deposition time and/or thickness of coating 610 deposited on surface 228. The wrinkled texture of coating 610 may increase the coefficient of friction of surface 228. Coating 610 may have a roughness between approximately 40 nm and 120 nm and a coefficient of friction between approximately 0.25 and 2.0. The roughness of coating 610 An increase in the coefficient of friction may reducing wear particle generation and thus reduce erosion of surface 228. Additionally, an increase in the coefficient of friction of surface 228 may reduce the likelihood that particles circulating in the drilling fluids flowing over surface 228 will stick to surface 228. Reduced particle accumulation on surface 228 may reduce drag forces on surface 228.

Figure 7:
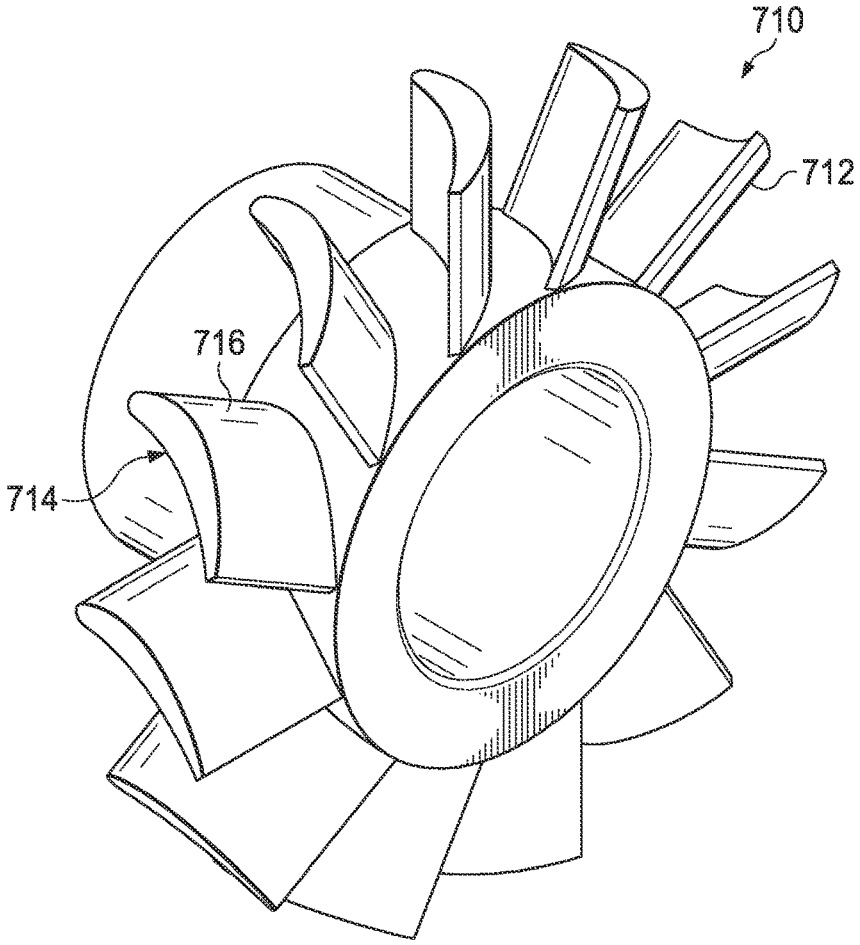
FIG. 7 is a turbine including surfaces configured to reduce drag forces and erosion caused by drilling fluids.

Although the configuration of a surface to reduce drag forces and erosion caused by drilling fluids has been discussed in the context stabilizers 224 (shown in FIG. 2), the teachings of this disclosure may be utilized to configure a surface of any component exposed to the flow of drilling fluids. For example, FIG. 7 illustrates a turbine including surfaces that may be configured to reduce drag forces and erosion caused by drilling fluids. Turbine 710 may be included in BHA 120 (shown in FIG. 1). Drilling fluids may circulate through turbine 710, resulting in a rotational force that induces rotation of components 122 of BHA 120 (shown in FIG. 1). Turbine 710 may include a plurality of blades 712. The flow of drilling fluids through turbine 710 may exert a drag force on blades 712 as they rotate within turbine 710. Additionally, the flow of drilling fluids through turbine 710 may cause the surfaces of blades 712 to erode. To reduce the drag forces and erosion caused by the flow of drilling fluids, surfaces 714 and 716 of blades 712 may be configured to include one or more of: (a) a series of nodules separated by channels (shown in FIGS. 3A and 3B), (b) a series of ribs separated by channels and aligned with a direction of the fluid flow (shown in FIGS. 4A and 4B), (c) nanotubes (shown in FIGS. 5A and 5B), and (d) a wrinkled, diamond-like coating (shown in FIGS. 6A-6C).

Although configuring surfaces to reduce drag forces and erosion caused by fluid flow has been discussed in the context of drilling systems, the teachings of this disclosure may be applied to other environments, including but not limited to refineries, power plants, chemical plants, pumping stations, water treatment plants, any other environment where components are exposed to fluid flow. As discussed above with respect to FIGS. 2-7, the surfaces of components in such environments may be configured to reduce the drag forces and erosion caused by fluid flow by including one or more of: (a) a series of protrusions, including nodules (shown in FIGS. 3A-3B) or ribs (shown in FIGS. 4A-4B), separated by channels formed on the surface, (b) an array of nanotubes (shown in FIGS. 5A-5B) formed on the surface, or (c) a diamond-like coating (shown in FIGS. 6A-6C) deposited on the surface.

Figure 8:
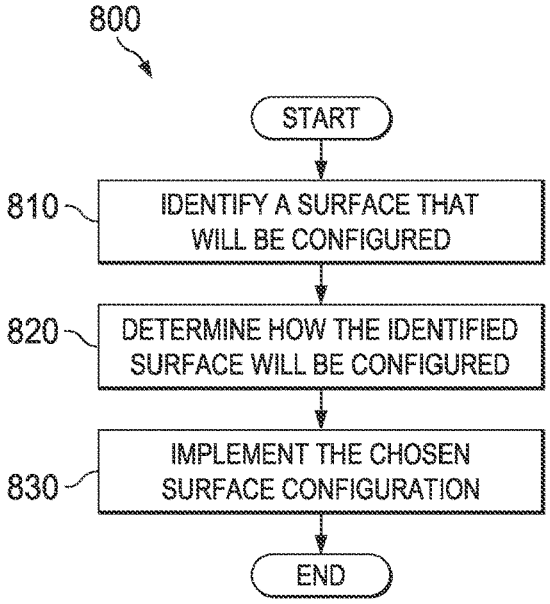
FIG. 8 is a flow chart of a method for configuring a surface of a component exposed to fluid flow to reduce drag and erosion.

FIG. 8 illustrates a method of configuring a surface exposed to fluid flow to reduce drag and erosion. Method 800 may begin, and at step 810 a surface of a component that will be configured to reduce drag forces and erosion may be identified. The flow of fluids over a surface of a component may cause erosion and may increase the drag forces exerted on the surface, particularly where the component rotates during operation.

At step 820, a determination may be made regarding how the identified surface will be configured to reduce drag forces and erosion caused by fluids flowing over the surface. As discussed above with respect to FIGS. 3A-3B, forming a series of nodules on a surface exposed to fluid flow may decrease the impact velocity of the fluids flowing over the surface and thus reduce drag forces and erosion caused by the fluids. Additionally, as discussed above with respect to FIGS. 4A-4B, forming a series of ribs aligned in the direction of fluid flow on a surface may reduce turbulence in the fluids flowing over the surface and thus reduce drag forces and erosion caused by the fluids. Further, as discussed above with respect to FIGS. 5A-5B, forming nanotubes on a surface exposed to fluid flow may reduce drag forces caused by fluids flowing over the surface by preventing particles circulating in the fluids from sticking or adhering to the surface. Additionally, forming nanotubes on a surface exposed to fluid flow may reduce the impact velocity of erosive particles circulating in the fluid and thus reduce erosion cause by the impact of erosive particles. And as discussed above with respect to FIGS. 6A-6C, depositing a diamond-like coating with a wrinkled texture on a surface exposed to fluid flow may reduce drag forces and erosion caused by the fluid by reducing wear particle generation and reducing the likelihood that particles circulating in the fluid flowing over the surface will stick to the surface.

At step 830, the surface configuration chosen at step 820 may be implemented. As discussed above with respect to FIGS. 3A-3B and 4A-4B, a series of nodules or ribs separated by channels may be formed on a surface using a variety of methods. For example, material may be removed from the surface using a machine tool or a chemical etching process to form channels. The material not removed from the surface in this process may form the nodules or ribs. As another example, material may be deposited on the surface using a physical or chemical deposition process to form a series of nodules or ribs. As yet another example, the surface may be stamped or the component may be molded to form a series of nodules or ribs separated by channels. As still another example, a series of nodules or ribs may be formed on a surface using an ion implantation process.

As discussed above with respect to FIGS. 5A-5B, an array of flexible nanotubes may be formed on a surface or on a substrate that is later coupled to the surface. The nanotubes may densely populate the surface such that particles in fluids flowing over the surface impact one or more of the nanotubes before impacting the surface. The nanotubes may include single-walled carbon nanotubes (e.g., nanotubes formed of a single one-atom thick sheet of carbon rolled into a tube) or multi-walled carbon nanotubes (e.g., nanotubes formed from multiple sheets of carbon rolled into a tube). As shown in FIG. 5A, nanotubes may be formed on a surface including nodules. Nanotubes may also be formed on a surface ribs, or on a surface that includes neither nodules nor ribs.

As discussed above with respect to FIGS. 6A-6C, a diamond-like coating with a wrinkled texture may be deposited on a surface. The diamond-like coating may be applied to a surface that includes nodules (shown in FIGS. 3A-3B) or ribs (shown in FIGS. 4A-4B) or may be applied to a surface and then etched to form a series of nodules or ribs. The diamond-like coating may be deposited on the surface using a physical or chemical deposition process. The wrinkled texture of the diamond-like coating may be achieved by increasing the deposition time and/or thickness of the coating deposited on the surface.

Modifications, additions, or omissions may be made to method 800 without departing from the scope of the present disclosure. For example, the order of the steps may be performed in a different manner than that described and some steps may be performed at the same time. Additionally, each individual step may include additional steps without departing from the scope of the present disclosure.

Embodiments disclosed herein include:

A. A drilling system that includes a drill string and a bottom hole assembly coupled to and disposed downhole from the drill string. The bottom hole assembly includes a plurality of protrusions formed on a surface of the bottom hole assembly, a plurality of channels separating the plurality of protrusions, and a coating deposited on the surface, the coating formed of a diamond-like carbon and having a wrinkled texture.

B. A drilling system that includes a drill string, and a bottom hole assembly coupled to and disposed downhole from the drill string. The bottom hole assembly includes a plurality of protrusions formed on a surface of the bottom hole assembly, a plurality of channels separating the plurality of protrusions, and a plurality of nanotubes formed on the surface.

C. A method of configuring a surface of a component exposed to fluid flow that includes forming a plurality of protrusions on a surface, the plurality of protrusions separated by a plurality of channels, and depositing a coating on the surface to increase a coefficient of friction of the surface, the coating formed of a diamond-like carbon and having a wrinkled texture.

D. A method of configuring a surface of a component exposed to fluid flow that includes forming a plurality of protrusions on a surface, the plurality of protrusions separated by a plurality of channels, and forming a plurality of nanotubes on the surface.

Each of embodiments A, B, C, and D may have one or more of the following additional elements in any combination: Element 1: wherein the plurality of protrusions comprises a plurality of nodules configured to decrease an impact velocity of a fluid flowing over the surface. Element 2: wherein the plurality of protrusions comprises a plurality of ribs aligned with a direction of fluid flow over the surface. Element 3: wherein the plurality of ribs is configured to reduce a turbulence of a fluid flowing over the surface. Element 4: wherein the coating has a roughness between approximately 40 nm and approximately 120 nm. Element 5: wherein the coating has a coefficient of friction between approximately 0.25 and approximately 2.0. Element 6: wherein the plurality of nanotubes comprise single-walled carbon nanotubes or multi-walled carbon nanotubes. Element 7: wherein forming the plurality of protrusions comprises etching a plurality of channels in the coating deposited on the surface. Element 8: wherein the plurality of protrusions are formed using an ion implantation process. Element 9: wherein the plurality of nanotubes comprise single-walled carbon nanotubes or multi-walled carbon nanotubes.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A drilling system, comprising:

a drill string; and a bottom hole assembly coupled to and disposed downhole from the drill string, the bottom hole assembly comprising:

a plurality of protrusions formed on a surface of the bottom hole assembly, each of the plurality of protrusions having a shape based on an anticipated fluid flow condition during a drilling operation;

a plurality of channels separating the plurality of protrusions; and a plurality of nanotubes formed on the surface and oriented in an array that follows a contour of the surface, each of the plurality of nanotubes having a length between 10 nm and 1.5 μm and a diameter between 50 nm and 100 nm.

2. The drilling system of claim 1, wherein the plurality of protrusions comprises a plurality of nodules configured to decrease an impact velocity of a fluid flowing over the surface.

3. The drilling system of claim 1, wherein the plurality of protrusions comprises a plurality of ribs aligned with a direction of fluid flow over the surface.

4. The drilling system of claim 3, wherein the plurality of ribs is configured to reduce a turbulence of a fluid flowing over the surface.

5. The drilling system of claim 1, wherein the plurality of nanotubes comprise single-walled carbon nanotubes or multi-walled carbon nanotubes.

6. A method of configuring a surface of a bottom hole assembly component exposed to fluid flow, comprising:

choosing a configuration for a plurality of protrusions on a surface, the plurality of protrusions separated by a plurality of channels;

choosing a shape for each of the plurality of protrusions based on an anticipated fluid flow condition during a drilling operation; and selecting a configuration for a plurality of nanotubes on the surface such that the plurality of nanotubes are oriented in an array that follows a contour of the surface, each of the plurality of nanotubes having a length between 10 nm and 1.5 μm and a diameter between 50 nm and 100 nm.

7. The method of claim 6, wherein the plurality of protrusions comprises a plurality of nodules configured to decrease an impact velocity of a fluid flowing over the surface.

8. The method of claim 6, wherein the plurality of protrusions comprises a plurality of ribs aligned with a direction of fluid flow over the surface.

9. The method of claim 8, wherein the plurality of ribs is configured to reduce a turbulence of a fluid flowing over the surface.

10. The method of claim 6, wherein forming the plurality of protrusions comprises etching a plurality of channels in the coating deposited on the surface.

11. The method of claim 6, further comprising selecting an ion implantation process for forming the plurality of protrusions.

12. The method of claim 6, wherein the plurality of nanotubes comprise single-walled carbon nanotubes or multi-walled carbon nanotubes.

* * * * *